United States Patent [19]

Jongkind

[11] 4,100,038

[45] Jul. 11, 1978

[54] PLATING ON ALUMINUM ALLOYS

[75] Inventor: Jan C. Jongkind, East Detroit, Mich.

[73] Assignee: M&T Chemicals Inc., Stamford, Conn.

[21] Appl. No.: 849,633

[22] Filed: Nov. 8, 1977

[51] Int. Cl.[2] ..... C25D 5/44

[52] U.S. Cl. ..... 204/38 B; 204/33

[58] Field of Search ..... 204/33, 38 B; 427/327, 427/328

[56] References Cited

U.S. PATENT DOCUMENTS

| | | | |
|---|---|---|---|
| 3,108,006 | 10/1963 | Kenedi et al. | 204/38 B |
| 3,274,021 | 9/1966 | Jongkind et al. | 427/436 |
| 3,616,291 | 10/1971 | Wilson | 204/38 B |
| 3,915,667 | 10/1975 | Ricks | 204/33 |

*Primary Examiner*—John H. Mack
*Assistant Examiner*—William Leader
*Attorney, Agent, or Firm*—Kenneth G. Wheeless; Robert Spector

[57] ABSTRACT

In accordance with certain of its aspects, the process of this invention for plating aluminum comprises contacting said aluminum with an aqueous activating bath containing a stannate salt selected from the group consisting of sodium stannate and potassium stannate in a concentration of about 40 grams per liter of tin as stannate; of at least one member of the group consisting of sodium and potassium hydroxide in a concentration of from 1.2 grams per liter to 12 grams per liter; and 0.01 gram per liter to 25 grams per liter of at least one member of the group consisting of methyl cellulose ethers, polyvinyl alcohols, polyethylene oxide, and polyethylene glycols; maintaining said aluminum and said aqueous bath in contact thereby activating the surface of said aluminum, withdrawing from said aqueous bath said aluminum bearing a film of said aqueous bath, immersing said aluminum bearing said film as cathode in an alkaline bronze strike bath containing an anode thereby depositing a bronze strike plate on said aluminum, and establishing a negative potential on said aluminum bearing said film with respect to said anode prior to the time said aluminum is immersed in said alkaline bronze strike bath.

7 Claims, No Drawings

PLATING ON ALUMINUM ALLOYS

This invention comprises an improved method of plating on aluminum alloys whereby the cleaned aluminum alloy is activated in a solution containing at least 40 g/l of tin as stannate, hydroxyl ion in the concentration range of 1.2 to 12 g/1, a compound selected from the group consisting of methyl cellulose ethers, polyvinyl alcohol, polyethylene oxide or polyethylene glycol in concentrations up to the limit of their solubility, and at temperatures from 15° C – 30° C, then transferring the said aluminum to an alkaline, cyanide Sn-Cu alloy strike bath and electrodepositing a Sn-Cu alloy deposit which can be used as a base for further plating.

It was found especially difficult to process aluminum alloys containing zinc using transfer times of more than 30 seconds. These longer transfer times are necessary when plating aluminum parts such as automobile bumpers on high volume automatic plating machines.

Transfer times of 30 seconds and longer may result in a small region of blisters on the sharp edges of the part. Such a product is unacceptable. Identical parts processed one by one through handline, where fast transfer can be achieved (less than 20 seconds) do not show these blister areas and can be satisfactorily processed further by Cu-Ni-Cr plating.

Automatic machines cannot transfer the racks containing the bumpers in less than 20 seconds because these racks may carry up to 12 bumpers at a time. The combined weight of the rack and bumprs is such that a smooth transfer from one tank to another tank, without swaying and splashing, in less than 20 seconds becomes exceedingly difficult. Therefore, if a process could be modified in such a way that the transfer time of 30 or more seconds could be tolerated, the process could be used in commercial lines.

The problem of necessary short transfer times is especially troublesome when using parts made out of zinc containing alloys, such as bumpers made from 7016, X7146, X7046 or X7029 alloys. Some 6000 series alloys may be troublesome in this respect also. The 7000 series alloys are preferred alloys for the manufacture of bumpers because their physical properties are superior for this application but seem to be even less tolerant to long transfer times than other alloys.

The composition of this invention and careful control of variables such as temperature and free hydroxide, results in transfer times of at least 45 seconds.

It is an object of this invention to provide a process for plating aluminum and its alloys. A particular object of the invention is to provide electroplated articles which are especially resistant to lateral corrosion and resultant blistering of the electrodeposit. Other objects will be apparent to those skilled in the art from inspection of the following description.

In accordance with certain of its aspects, the process of this invention for plating aluminum comprises contacting said aluminum with an aqueous activating bath substantially free of active copper ions containing a stannate salt selected from the group consisting of sodium stannate and potassium stannate in a concentration of about 40 grams per liter of tin as stannate; of at least one member of the group consisting of sodium and potassium hydroxide in a concentration of from 1.2 grams per liter to 12 grams per liter; and 0.01 gram per liter to 25 grams per liter of at least one member of the group consisting of methyl cellulose ethers, polyvinyl alcohols, polyethylene oxide, and polyethylene glycols; maintaining said aluminum and said aqueous bath in contact thereby activating the surface of said aluminum, withdrawing from said aqueous bath said aluminum bearing a film of said aqueous bath, immersing said aluminum bearing said film as cathode in an alkaline bronze strike bath containing an anode thereby depositing a bronze strike plate on said aluminum, and establishing a negative potential on said aluminum bearing said film with respect to said annode prior to the time said aluminum is immersed in said alkaline bronze strike bath.

The aluminum metal which may be treated in practise of this invention may include pure aluminum metal and alloys. Typical of such aluminum alloys may be those containing various proportions of other metals including copper, chromium, zinc, nickel, magnesium, silicon, and manganese. A typical aluminum alloy may be that commercially identified as aluminum alloy No. 1100 which may contain 99+% aluminum.

A second typical aluminum alloy may be that commercially identified as aluminum alloy No. 5052 having the following composition:

| No. 5052 | % |
|---|---|
| aluminum | 96.1–96.9 |
| silicon and iron | 0.45 |
| copper | 0.10 |
| manganese | 0.10 |
| magnesium | 2.2–2.8 |
| chromium | 0.15–0.35 |
| zinc | 0.10 |

The following may be typical of other aluminum alloys:

| NO. 356 | % |
|---|---|
| aluminum | 91.4–92.84 |
| silicon | 6.5–7.5 |
| iron | 0.13–0.30 |
| copper | 0.10 |
| manganese | 0.05 |
| magnesium | 0.3 |
| zinc | 0.05 |
| titanium | 0.08–0.20 |

| No. 2024 | % |
|---|---|
| aluminum | 92.05 |
| magnesium | 1.5 |
| chromium | 0.1 |
| copper | 4.5 |
| iron | 0.5 |
| silicon | 0.5 |
| manganese | 0.6 |
| zinc | 0.25 |

In practise of the process of this invention, the aluminum to be treated may preferably have been cleaned. Typically cleaning may have included placing the aluminum metal in a vapor degreasing operation, typically using trichloroethylene. The metal may preferably then be further cleaned in an alkaline cleaner, typically by immersion in a 1% – 5%, say 3% aqueous solution of sodium hydroxide, sodium orthophosphate, sodium carbonate, etc. or mixtures thereof.

The metal may be further cleaned by treatment with acid. Typically this may be effected by dipping into a solution containing an acid mixture with oxidizing properties such as sulfuric acid and hydrogen peroxide. The metal may be maintained in the acid for 10 – 120, say 30 seconds.

Preferably after acid dipping, the aluminum may be rinsed in water to remove the acid which may remain on the surface. Typically rinsing may be effected by dipping in a body of water for 20 seconds — 3 minutes, say 1 minute.

In practise of this invention, the aluminum may be activated by contact with a solution of sodium stannate or potassium stannate. Preferably contact may be made by immersing the cleaned aluminum in a solution of potassium stannate having a tin content of 10 g/1 - 70 g/l, say 40 g/l. Immersion may be effected for 5 - 120 seconds. Preferably the solution may be maintained at 15° C - 30° C, say 21° C during the contact with the aluminum.

The activating stannate baths of this invention contain free hydroxide, typically potassium hydroxide, in an amount of 1.2 to 12 grams per liter when expressed as equivalent potassium hydroxide.

Preferably the activating stannate solution may contain 0.01 - 25 g/l of addition agent selected from the group consisting of methyl cellulose ethers, polyvinyl alcohols, polyethylene oxide and polyethylene glycols.

Preferably, the stannate bath may not be agitated during the deposition of this this thin film.

After the 5 - 120 second immersion, the aluminum bearing the thin film may be passed to an alkaline bronze strike bath. A typical bronze alkaline strike bath may contain tin, copper cyanide CuCN, potassium cyanide KCN, potassium hydroxide KOH, and preferably additives including e.g. Rochelle salts, gluconates, versenates, etc.

It is preferred to describe these bronze baths in terms of their content of (a) potassium cuprocyanide 2KCN.CuCN, (b) free potassium cyanide KCN, and (c) potassium hydroxide KOH. A typical copper alkaline bath may contain the followng:

| Component | Amount g/l | Preferred g/l |
|---|---|---|
| 2KCN . CuCN | 25 - 100 | 56 |
| tin | 10 - 85 | 30 |
| Free KCN | 10 - 30 | 20 |
| KOH | 0 - 5 | 5 |
| Additive: Rochelle salt | 15 - 25 | 20 |

Alkali stannate in solution supplies the tin contained in the copper-tin alloy.

In practice of the process of this invention, the aluminum which may have been immersed in the activating stannate solution may be withdrawn from the stannate solution and immediately transferred to the alkaline bronze strike bath.

It is a feature of the process of this invention that the aluminum bearing the activating film thereon be maintained in quiescent state, i.e. in contact with a layer of stannate solution. The aluminum will bear a film of liquid from the aqueous bath. If desired, the film may be produced by gently spraying the solution onto the aluminum piece after it is cleaned. Preferably, however, the aluminum piece will be quiescently maintained in the solution for the noted 5 - 120 seconds and then without delay passed to the alkaline strike bath.

In the preferred embodiment, the alkaline strike bath may contain an anode which is connected to a source of current. Preferably the aluminum, bearing the layer of stannate solution, will before being dipped into the alkaline strike solution be made cathodic to the anode by connecting the aluminum to the negative pole of the said current source. Thus when the aluminum is immersed in the alkaline strike solution, it will be cathodic to the anode therein. This procedure of entering a solution with previous electrical contact is referred to as a "hot contact". Thus during the period of about 60 seconds after the aluminum is withdrawn from the stannate bath until the time when the aluminum is immersed in the alkaline strike solution, it will be continuously charged with electrons and thereby be cathodic to the anode in the strike bath. Normally the period of time during which the aluminum may be a "hot contact" may be very short, typically 2 - 20 seconds, say 10 seconds.

The "hot" or cathodically charged aluminum bearing the film of stannate solution may be immersed into the alkaline bronze strike bath. Preferably it will remain in the bath for 45 - 300 seconds, typically 180 seconds at 20° C - 65° C, say 30° C, the temperature depending on the particular alkaline strike bath employed. Current density may fall within the range of 1 to 10 asd.

During this period, the cathode acquires an adherent deposit of bronze. The bronze, as deposited, is satisfactory for use as a final plate or deposit or it may be used as a base for further plating. The bronze plate may be equivalent in all respects to plate deposited on other metals by known commercial processes.

In the preferred embodiment of this invention, the aluminum bearing the bronze plate may be further plated with a plate of any other metal including chromium, nickel, tin, copper, etc.

Practise of this invention may be observed from the following examples.

TESTING PROCEDURE

A panel of aluminum was buffed and treated as follows:

1. Remove grease by wiping with organic solvent.
2. Alkaline clean in commercial alkaline cleaner. Temperature: 150° F; Time: 60 seconds.
3. Water Rinse
4. Water Rinse
5. Acid dip: 50% nitric acid + 30 g of ammonium bifluoride
6. Water Rinse
7. Water Rinse
8. Immersion in activating solution for 20 seconds.
9. Transfer to step 10 (transfer time 45 seconds).
10. Electroplate in bronze solution 4 min. — 30 ASF — 80° F, hot lead in.
11. Water Rinse
12. Acid dip ($H_2SO_4$ 5%)
13. Water Rinse
14. Conventional bright acid copper plate, followed by conventional bright nickel plate, combined thickness 1 mil.

Testing of panels: The panels were tested by hammering, grinding, bending and sawing. If none of these operations showed separation of the plate from the aluminum, adhesion was considered good.

EXAMPLES OF ACTIVATING SOLUTIONS AND CONDITIONS

| Immersion Time 20 Seconds - Transfer Time 45 Seconds | | | | |
|---|---|---|---|---|
| K Stannate g/l | KOH g/l | Temperature ° F | Additive | Adhesion Result |
| 167 | 4.25 | 70 | No | Failure |
| 167 | 4.25 | 70 | Methocell .75 g/l | Good |
| 100 | 4.65 | 78 | Methocell .75 g/l | Good |

-continued

| Immersion Time 20 Seconds - Transfer Time 45 Seconds | | | | |
|---|---|---|---|---|
| K Stannate g/l | KOH g/l | Temperature ° F | Additive | Adhesion Result |
| 100 | 4.65 | 80 | PVA .5 g/l (Polyvinyl alcohol) | Good |
| 100 | 4.65 | 75 | Polyol .5 g/l (Polyethylene oxide) | Good |
| 100 | 4.65 | 75 | PEG .5 g/l (Polyethylene glycol) | Good |

Alloys tested:
Extruded X7046, X7146
Sheet X7146, X7046
Extruded X7029
Sheet X7029
Extruded X7016

Although this invention has been described with reference to specific examples, it will be apparent to those skilled in the art that various modifications may be made thereto which fall within the scope of this invention.

What is claimed is:

1. The process for plating aluminum and aluminum alloys which comprises contacting said aluminum with an aqueous activating bath substantially free of active copper ions containing a stannate salt selected from the group consisting of sodium stannate and potassium stannate in a concentration of 10 – 70 grams per liter of tin as stannate; at least one member of the group consisting of sodium and potassium hydroxide in a concentration of from 1.2 grams per liter to 12.0 grams per liter; and 0.01 gram per liter to 25 grams per liter of at least one member of the group consisting of methyl cellulose ethers, polyvinyl alcohols, polyethylene oxide, and polyethylene glycols; maintaining said aluminum and said aqueous bath in contact thereby activating the surface of said aluminum, withdrawing from said aqueous bath said aluminum bearing a film of said aqueous bath, immersing said aluminum bearing said film as cathode in an alkaline bronze bath containing an anode thereby depositing a strike plate on said aluminum, and establishing a negative potential on said aluminum bearing said film with respect to said anode prior to the time said aluminum is immersed in said alkaline bronze bath.

2. The process for plating aluminum as claimed in claim 1 wherein said aqueous activating bath contains 10 – 70 g/l of tin as stannate salt.

3. The process for plating aluminum as claimed in claim 1 wherein aluminum is contacted with said stannate bath for 5 – 120 seconds.

4. The process for plating aluminum as claimed in claim 1 wherein aluminum is contacted with said stannate bath at a temperature of 15° C – 30° C.

5. The process for plating aluminum as claimed in claim 1 wherein said stannate bath contains free hydroxide in amount of 1.2 to 12.0 g/l.

6. The process for plating aluminum as claimed in claim 1 wherein said stannate bath contains 0.01 – 25 g/l of addition agent selected from the group consisting of methyl cellulose ethers, polyvinyl alcohols, polyethylene oxide, polyethylene glycol in concentrations up to the limit of the solubility of each.

7. The process for plating aluminum and aluminum alloys which comprises, seriation, cleaning said aluminum in at least one alkaline cleaner, rinsing said aluminum in water, dipping said aluminum in an acidic solution, sequentially rinsing said aluminum, contacting said aluminum with an aqueous activating bath containing 10 g/l – 70 g/l tin in the form of a stannate salt selected from the group consisting of sodium stannate and potassium stannate, at least one member of the group consisting of sodium hydroxide and potassium hydroxide in a concentration of from 1.2 grams per liter to 12.0 grams per liter; and 0.01 gram per liter to 25 grams per liter of at least one member of the group consisting of methyl cellulose ethers, polyvinyl alcohols, polyethylene oxide and polyethylene glycols, maintaining said aluminum and said aqueous bath in contact for 5 – 120 seconds at 15° C – 30° C thereby activating the surface of said aluminum, withdrawing from said aqueous bath said aluminum bearing a film of said aqueous bath, immersing said aluminum bearing said film as cathode in a bronze bath containing an anode thereby depositing a bronze plate on said aluminum, and establishing a negative potential on said aluminum bearing said film with respect to said anode prior to the time said aluminum is immersed in said bronze bath, rinsing said bronze plated aluminum, in water, and subsequently electroplating said adherent bronze deposit with commercial deposits such as copper, tin, and nickel.

* * * * *